US008979675B2

(12) United States Patent
Bender et al.

(10) Patent No.: US 8,979,675 B2
(45) Date of Patent: Mar. 17, 2015

(54) GOLF BALL CORE HAVING RADIAL APPENDAGES

(75) Inventors: Aaron Bender, Portland, OR (US); Kerby LaVar Maxwell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 323 days.

(21) Appl. No.: 13/455,656

(22) Filed: Apr. 25, 2012

(65) Prior Publication Data

US 2013/0288825 A1 Oct. 31, 2013

(51) Int. Cl.

| | |
|---|---|
| ***A63B 37/06*** | (2006.01) |
| ***A63B 37/00*** | (2006.01) |
| ***A63B 43/00*** | (2006.01) |
| ***A63B 45/00*** | (2006.01) |

(52) U.S. Cl.

CPC ..... *A63B 37/0003* (2013.01); *A63B 37/004* (2013.01); *A63B 37/0043* (2013.01); *A63B 37/0046* (2013.01); *A63B 37/006* (2013.01); *A63B 37/0062* (2013.01); *A63B 37/0076* (2013.01); *A63B 37/0097* (2013.01); *A63B 43/002* (2013.01); *A63B 45/00* (2013.01)

USPC ..... 473/370

(58) Field of Classification Search

CPC ..... A63B 37/0097; A63B 37/02; A63B 37/0005; A63B 37/0055

USPC ..... 473/370, 371

See application file for complete search history.

(56) References Cited

U.S. PATENT DOCUMENTS

| | | | | |
|---|---|---|---|---|
| 5,692,973 | A * | 12/1997 | Dalton | 473/374 |
| 5,820,485 | A * | 10/1998 | Hwang | 473/361 |
| 5,836,834 | A * | 11/1998 | Masutani et al. | 473/374 |
| 5,984,807 | A * | 11/1999 | Wai et al. | 473/376 |
| 6,012,991 | A | 1/2000 | Kim et al. | |
| 6,155,935 | A | 12/2000 | Maruko | |
| 6,379,270 | B2 | 4/2002 | Maruko et al. | |
| 6,383,091 | B1 * | 5/2002 | Maruko et al. | 473/373 |
| 6,406,385 | B1 | 6/2002 | Masutani et al. | |
| 6,503,155 | B2 | 1/2003 | Maruko et al. | |
| 6,629,898 | B2 | 10/2003 | Nardacci | |
| 6,835,146 | B2 | 12/2004 | Jordan et al. | |
| 6,884,182 | B2 * | 4/2005 | Nardacci | 473/374 |
| 2010/0160087 | A1 | 6/2010 | Nakamura et al. | |

FOREIGN PATENT DOCUMENTS

| | | | |
|---|---|---|---|
| WO | 2004085006 | A1 | 10/2004 |
| WO | 2006099146 | A2 | 9/2006 |

OTHER PUBLICATIONS

International Search Report and Written Opinion in PCT Application No. PCT/US2013/037993, mailed on Aug. 23, 2013.

* cited by examiner

*Primary Examiner* — Raeann Gorden

(74) *Attorney, Agent, or Firm* — Quinn Law Group, PLLC.

(57) ABSTRACT

A golf ball having a golf ball core, one or more intermediate layers and a cover layer is disclosed. The golf ball core may include an inner core having radial appendages. The radial appendages may protrude from the inner core in a spherically symmetrical pattern. The radial appendages may be formed from the same material as the inner core. The one or more intermediate layers may surround the inner core and fill the voids between the radial appendages.

12 Claims, 16 Drawing Sheets

GOLF BALL CORE HAVING RADIAL APPENDAGES

BACKGROUND

The present disclosure relates generally to a golf ball having a golf ball core having spherically symmetric radial appendages extending from an inner core. Further, the present disclosure relates to a golf ball having improved feel, control and sound.

The game of golf is an increasingly popular sport at both the amateur and professional levels. A wide range of technologies related to the manufacture and design of golf balls are known in the art. Such technologies have resulted in golf balls with a variety of play characteristics. For example, some golf balls have a better flight performance than other golf balls, in terms of initial velocity, spin, and total distance.

Similarly, a golfer may use different golf balls having different play characteristics depending on the golfer's preferences. For example, different dimple patterns may affect the aerodynamic properties of the golf ball during flight, or a difference in the hardness may affect the rate of backspin. With regard to hardness in particular, a golfer may choose to use a golf ball having a cover layer and/or a core that is harder or softer. A harder golf ball will generally achieve greater distances but less spin, and so will be better for drives but more difficult to control on shorter shots. On the other hand, a softer golf ball will generally experience more spin and therefore be easier to control, but will lack distance. Some golf balls with a good flight performance do not have a good feel when hit with a golf club. Some golf balls with good performance and feel lack durability.

Therefore, there exists a need in the art for a durable golf ball having spin control as well as good feel.

SUMMARY

A golf ball having a golf ball core, one or more intermediate layers and a cover layer is disclosed. The golf ball core may include an inner core having radial appendages. The radial appendages may protrude from the inner core in a spherically symmetrical pattern. The radial appendages may be formed from the same material as the inner core. The one or more intermediate layers may surround the inner core and fill the voids between the radial appendages. The cover layer surrounds the one or more intermediate layers and radial appendages.

In one aspect, the disclosure provides an inner core having radial appendages. The inner core may be made of a polymeric material. The polymeric material of the inner core may be a thermoplastic polymer. The radial appendages may be formed from the same material as the inner core.

In another aspect, the inner core and radial appendages may be made as one piece. The inner core and radial appendages may be formed by injection molding techniques. The inner core and radial appendages may be formed in one mold.

In a further aspect, the golf ball core may be surrounded by one or more intermediate layers. The one or more intermediate layers may surround the inner core and the radial appendages. The one or more intermediate layers may surround the inner core but may partially surround the radial appendages. The radial appendages may extend from the inner core through the one or more intermediate layers. The radial appendages may extend beyond the outer surface of the one or more intermediate layers.

In one aspect, the golf ball of the disclosure further comprises a cover layer surrounding the one or more intermediate layers and radial appendages. The radial appendages may extend beyond the outer surface of the one or more intermediate layers. The radial appendages may abut, or may be in direct contact with, the cover layer. In some embodiments, the radial appendages may extend into the cover layer. In other embodiments, the ends of the radial appendages may be embedded in the cover layer.

In another aspect, the disclosure provides a golf ball comprising one or more intermediate layers. The one or more intermediate layers may be made of a polymeric material. The polymeric material of the one or more intermediate layers may be a thermoplastic polymer. The one or more intermediate layers may be formed from the same thermoplastic polymer that forms the golf ball core. The one or more intermediate layers may be formed from a different thermoplastic material that forms the golf ball core. The one or more intermediate layers may have the same hardness as the golf ball core. The one or more intermediate layers may have a different hardness than the golf ball core. The one or more intermediate layers may have a hardness that is less than the hardness of the golf ball core.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

Embodiments of the disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
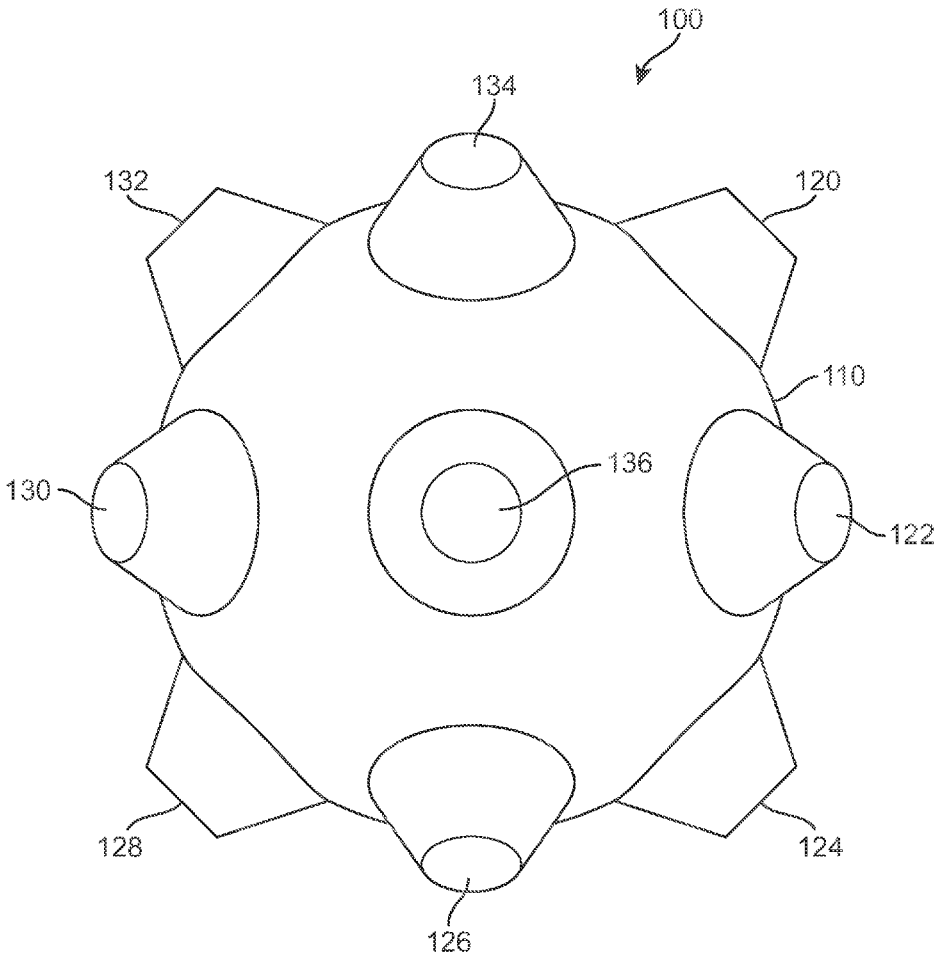
FIG. 1 shows an embodiment of a golf ball core with radial appendages.

Generally, this disclosure relates to a golf ball that includes a golf ball core having radial appendages extending from an inner core in a spherically symmetric pattern. In addition, the golf ball of the disclosure may have one or more intermediate layers and a cover layer.

The golf ball of the disclosure may be made by any suitable process. The process of making the golf ball may be selected based on a variety of factors. For example, the process of making the golf ball may be selected based on the type of materials used and/or the number of layers included. Exemplary processes are discussed herein with respect to the individual layers of the exemplary embodiment.

The golf ball core of the disclosure may include an inner core having radial appendages. The inner core may be any symmetric shape. The inner core may have a spherical shape. The radial appendages may extend from the inner core in a spherically symmetrical pattern. The number of radial appendages extending from the inner core may be selected based on a variety of factors. For example, the numbers of radial appendages may be selected based on the desired play characteristics of the finished golf ball. Any number of radial appendages may extend from the inner core so long as the radial appendages are arranged in a spherically symmetric pattern. At a minimum, the golf ball core may have six radial appendages.

The inner core of the disclosure may be made from any known golf ball material. In some embodiments, the material may be any material suitable for forming an inner core with radial appendages. In some embodiments, the inner core may be formed from any material that is suitable for use in an injection molding process. In some embodiments, the inner core may be formed from any material that is suitable for use in a reaction injection molding (RIM) process. In some embodiments, the material is a polymeric material. In some embodiments, the polymeric material may be a thermoplastic polymer or resin. In some embodiments, the polymeric material may be an ionomer. The type of material selected for the inner core may be selected based on a variety of factors. For example, the material used to form the inner core may be selected based on the desired play characteristics of the finished golf ball.

Embodiments of the disclosure may include provisions for controlling the transfer of force from the impact of a golf club from the cover layer to the inner core. Some of the provisions may enhance the transfer of force from the cover layer to the inner core. Other provisions may limit the transfer of force from the cover layer to the inner core. Some embodiments of the golf ball core can be shaped or designed to achieve the force transfer. The golf ball cores of the disclosure may have radial appendages to assist with the transfer of force from the cover layer to the inner core. The radial appendages of the golf ball can be arranges in a spherically symmetric pattern.

Embodiments of the radial appendages include radial appendages that are also resilient members of the golf ball core. Resilience can be defined as the ability to return to original form or position after being bent, compressed or stretched. Stated another way, resilience is the ability of a material to absorb energy when it is deformed elastically, and release that energy upon unloading. In some embodiments, the radial appendages are resilient to the force of an impact from a golf club.

In some embodiments, the radial appendages are made of the same material as the inner core. Further, the radial appendages and inner core may one piece. The golf ball core having an inner core and radial appendages may be formed by any suitable method. The method chosen to form the golf ball core may be based on the material used to form the golf ball core. The inner core may be formed by injection molding. The radial appendages and inner core may formed by injection molding. The radial appendages and inner core may be formed in a single mold.

The radial appendages may be formed into any size, shape or design. In some embodiments, the radial appendages may be columns extending outward from the inner core. Further, the radial appendages may be tapered columns where the base of the column that meets the inner core may be wider than the top of the column that abuts a cover layer. In addition, the top of the radial appendages may be flat or it may be convex or domed to match the curvature of a cover layer.

The shape or design of the radial appendages may be selected based on a variety of factors. The size and shape of the radial appendages may be selected to provide a finished golf ball with desired play characteristics. For example, the length of each radial appendage may vary based on the size the inner core. Further, wider radial appendages may be formed to provide the finished golf ball with a firmer feel. In some embodiments, thinner radial appendages may be formed to provide the finished golf ball with a softer feel. In addition, the golf ball core may contain a combination of radial appendages having different shapes and sizes.

FIG. 1 shows a golf ball core 100 having an inner core 110 and one or more radial appendage. In the embodiment shown in FIG. 1, golf ball 100 includes first radial appendage 120, second radial appendage 122, third radial appendage 124, fourth radial appendage 126, fifth radial appendage 128, sixth radial appendage 130, seventh radial appendage 132, eight radial appendage 134, and ninth radial appendage 136. Further, the radial appendages and inner core may be made from the same material. The radial appendages and inner core may be one piece.

As shown in FIG. 1, the radial appendages are arranged in a spherically symmetric pattern extending from inner core 110. Each radial appendage that extends from inner core 110 may have a corresponding appendage that extends from inner core 110 on the direct opposite side of inner core 110. For example, radial appendage 120 extends in one direction from inner core 110 on one side of inner core 110 and radial appendage 128 extends in the opposite direction from inner core 110 on the direct opposite side of inner core 110. In addition, the radial appendages may be spaced an equal distance from each other on inner core 110.

Figure 2:
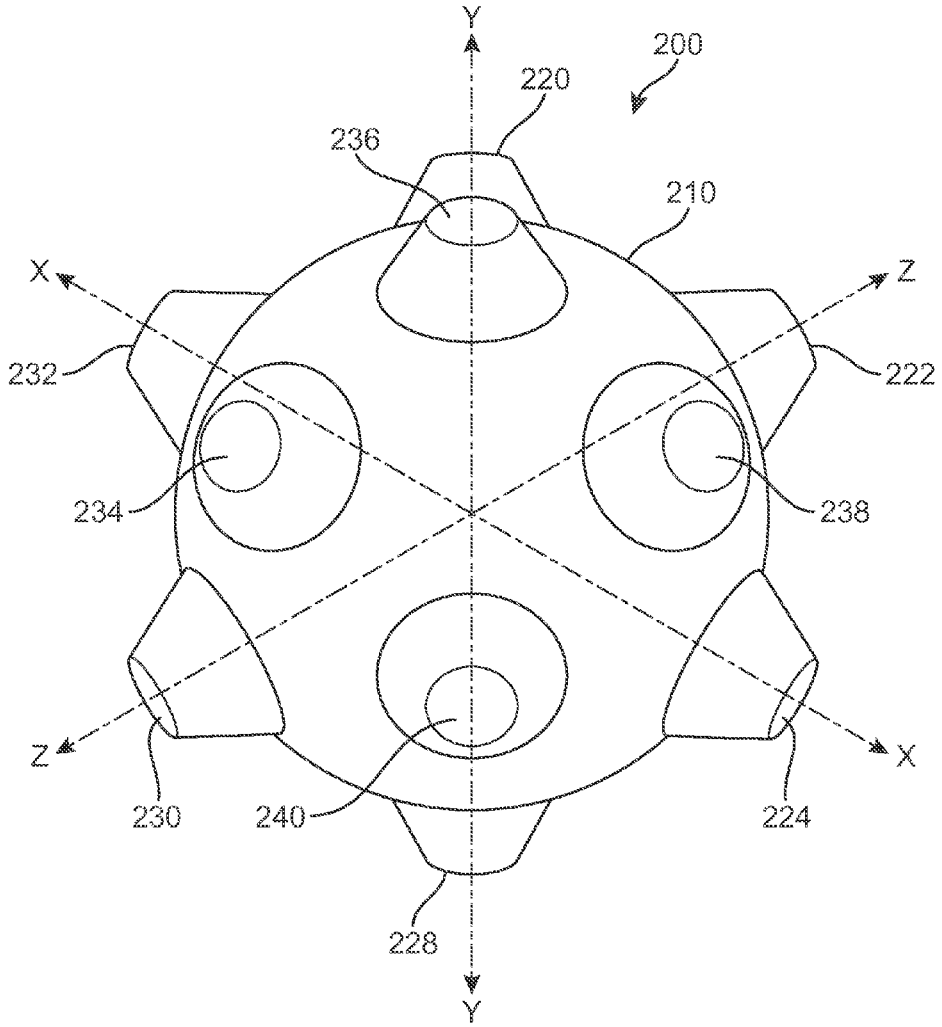
FIG. 2 shows an embodiment of a golf ball core with radial appendages situated about x, y, and z axes.

In three dimensions, an object may be defined by its x, y, and z coordinates. Similar to FIG. 1, FIG. 2 shows a golf ball core 200 having an inner core 210 and one or more radial appendage. In the embodiment shown in FIG. 2, golf ball 200 includes first radial appendage 220, second radial appendage 222, third radial appendage 224, fourth radial appendage 226, fifth radial appendage 228, sixth radial appendage 230, seventh radial appendage 232, eight radial appendage 234, ninth radial appendage 236, tenth radial appendage 238, and eleventh radial appendage 240. In addition, FIG. 2 shows the x, y, and z coordinates for golf ball core 200.

In the embodiment shown in FIG. 2, golf ball core 200 generally is spherically symmetric. Each radial appendage that extends from inner core 210 has a similar appendage that extends from inner core 210 on the opposite side of inner core 210. For example, second radial appendage 222 extends in one direction from inner core 210 on one side of the inner core and radial appendage sixth 230 extends in the opposite direction from inner core 210 on the direct opposite side of the inner core.

Similarly, other radial appendages may have corresponding appendages that are disposed on the opposite side of inner core 210. Locating appendages on opposite sides of inner core 210 helps to maintain spherical symmetry.

In addition, the radial appendages may be spaced an equal distance from each other on inner core 210. More specifically, the radial appendages may be spaced an equal distance to adjacent radial appendages as well as non-adjacent radial appendages. For example, in the embodiment shown in FIG. 2, eleventh radial appendage 240 may be spaced an equal first distance from adjacent fourth radial appendage 226, sixth radial appendage 230, ninth radial appendages 236, and tenth radial appendages 238. In addition, eleventh radial appendage 240 may be spaced an equal second distance from first radial appendage 220 and fifth radial appendage 228. Regulating and controlling the spacing between adjacent and non-adjacent appendages may also help maintain spherical symmetry.

Figure 3:
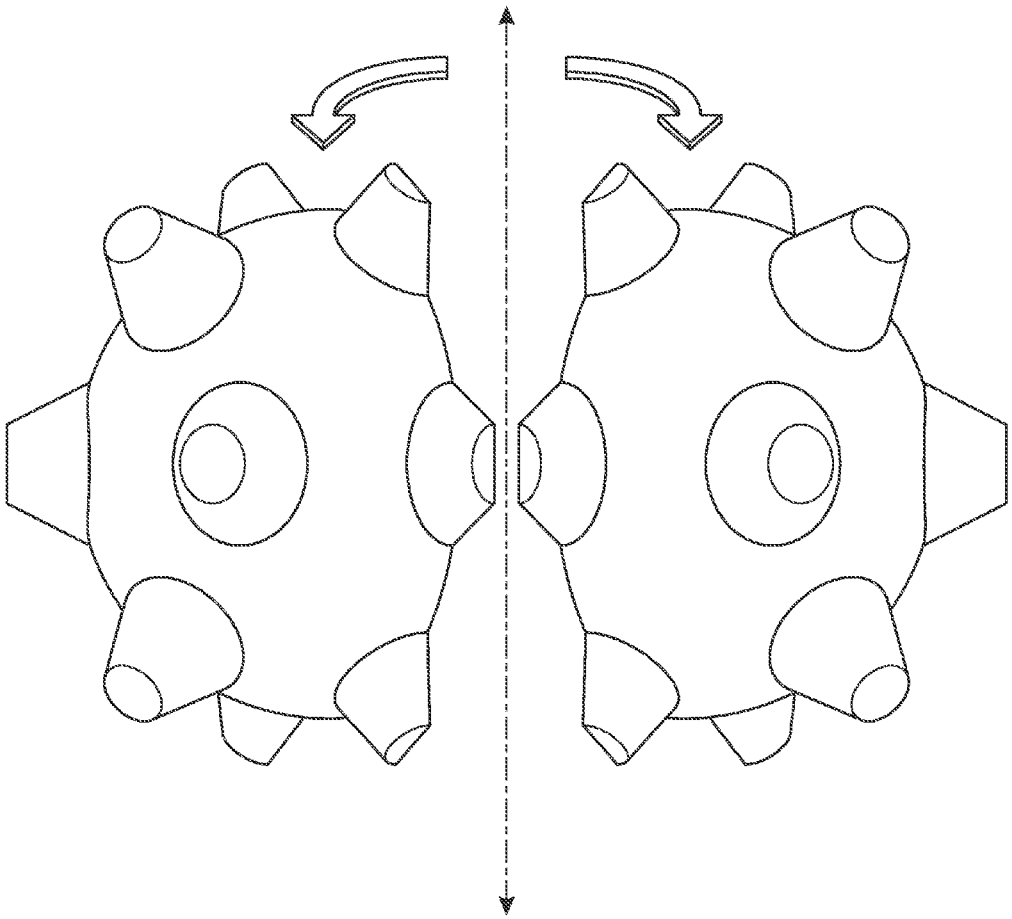
FIG. 3 shows an embodiment of a golf ball core with radial appendages that is have been split along a vertical plane, or the y, z plane, to show spherical symmetry.

More specifically, FIG. 3 shows a golf ball core split open along a vertical plane. FIG. 3 shows that the golf ball core generally is spherically symmetric. Each half of the split golf ball core contains the same number of radial appendages, which results in spherical symmetry. Further, the halves of the golf ball core show that equal number of radial appendages may be arranged in a spherically symmetric pattern. The golf ball core halves may be considered mirror images of each other.

Figure 4:
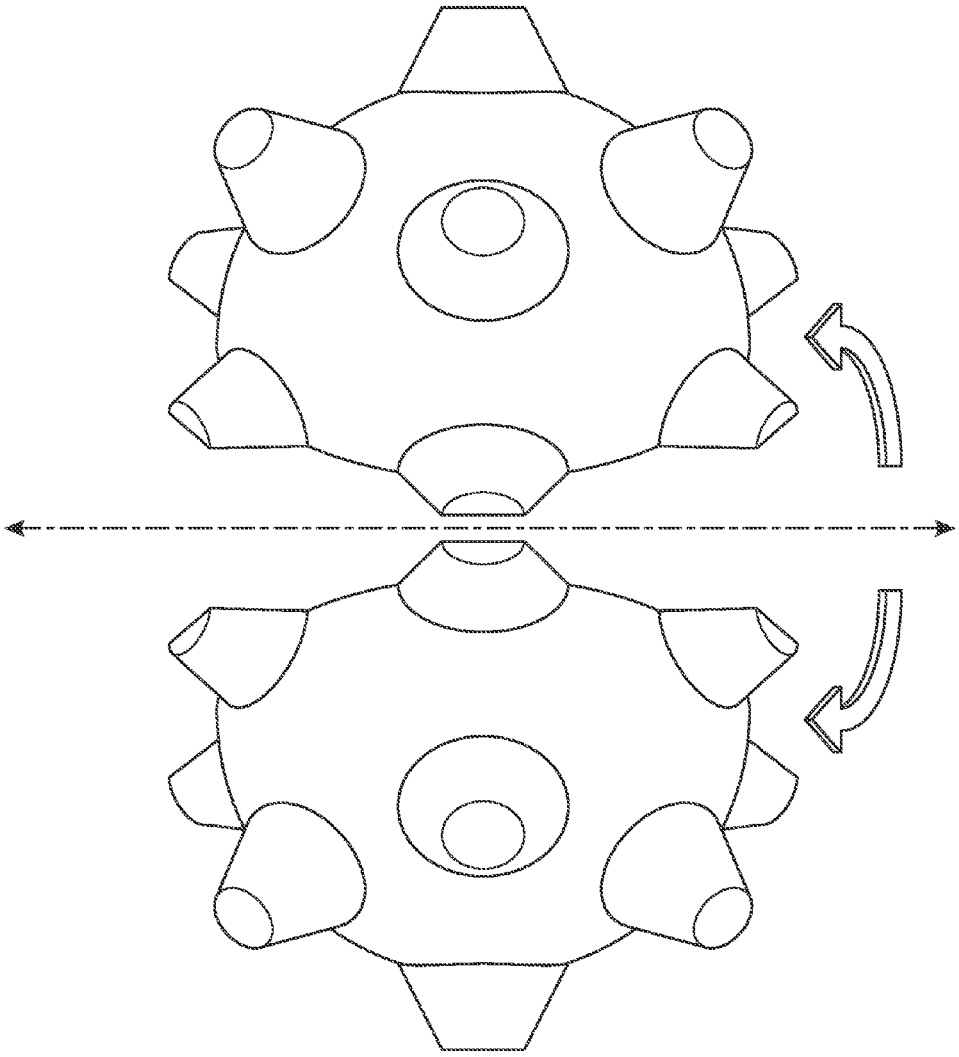
FIG. 4 is an illustration of an embodiment of a golf ball core with radial appendages that is have been split along a horizontal plane, or the x, z plane, to show spherical symmetry.

Similarly, FIG. 4 shows a golf ball core split open along a horizontal plane. FIG. 4 shows the golf ball core generally is spherically symmetric. Each half of the split golf ball core contains the same number of radial appendages. Further, the halves of the golf ball core show that equal number of radial appendages may be arranged in a spherically symmetric pattern. Once again, the shows that the golf ball core halves are mirror images of each other.

Figure 5:
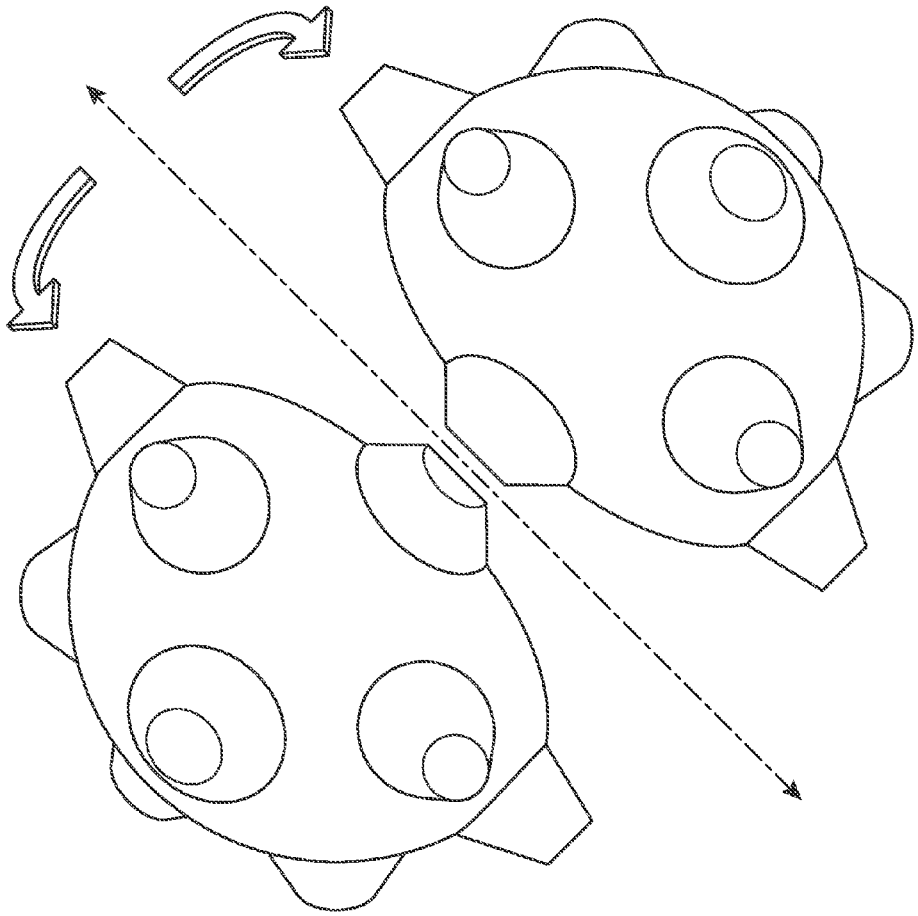
FIG. 5 is an illustration of an embodiment of a golf ball core with radial appendages that is have been split along a diagonal plane to show spherical symmetry.

Further, FIG. 5 shows a golf ball core split open along a diagonal plane. FIG. 5 shows that golf ball core 500 generally is spherically symmetric. Each half of the split golf ball core contains the same number of radial appendages. Further, the halves of the golf ball core show that equal number of radial appendages may be arranged in a spherically symmetric pattern. As can be seen, the golf ball core halves are mirror images of each other.

FIGS. 3, 4 and 5 illustrate the spherical symmetry of the golf ball core. For purposes of this disclosure, a golf ball core or a golf ball system is said to be spherically symmetric where the system is invariant under spatial rotation about a designated point, for example, the center of the golf ball. Further, in some embodiments, a golf ball core may be spherically symmetric where the golf ball core has regular angular increments between the radial appendages in any plane that includes the center of the golf ball core. In other embodiments, the golf ball core may be spherically symmetric where the golf ball core is divided into two halves along any arbitrary plane that includes the center, and the resultant two halves are substantially similar mirror-image pairs. In further embodiments, the golf ball core may be spherically symmetric when the golf ball core is mass balanced. For example, the golf ball core may be mass balanced when the golf ball core is either statically or dynamically balanced when treated as a rotating body.

Some embodiments of the golf ball may include one or more intermediate layers. The one or more intermediate layers may be radially spaced from, and surround the inner core. In addition, the one or more intermediate layers may fill in the spaces between the radial appendages. In some cases, one or more intermediate layers may completely encapsulate the inner core and radial appendages. In other embodiments, the radial appendages may extend beyond the outer surface of the one or more intermediate layers. On other words, the one or more intermediate layers may not completely encapsulate the radial appendages.

In some embodiments, the one or more intermediate layers may be made from any material suitable for golf balls. In some embodiments, the material may be any material suitable for forming an intermediate layer around a golf ball core. In some embodiments, the one or more intermediate layers may be formed from any material that is suitable for use in an injection molding process. In some embodiments, the one or more intermediate layers may be formed from any material that is suitable for use in a reaction injection molding (RIM) process. In some embodiments, the one or more intermediate layer may be made of any material suitable for compression molding. In some embodiments, the material may be a polymeric material. In some embodiments, the polymeric material includes a thermoplastic polymer or resin. In some embodiments, the polymeric material may be an ionomer.

In embodiments where two or more intermediate layers are formed, the materials forming the two or more layers may be the same as or different from each other. Further, the thickness of the two or more layers may be the same as or different from each other. In embodiments of the intermediate layers, where two or more layers are present an adhesive may be present between each individual layer. However, in other embodiments, the use of an adhesive may be omitted.

The thickness of the one or more intermediate layers may be selected based on upon a variety of factors. For example, the thickness of each intermediate layer may be selected to produce certain desired play characteristics of the finished golf ball. Further, the thickness of each layer maybe related to the size of the inner core of the golf ball core. As stated above, the intermediate layers may not completely encapsulate at least the ends of each radial appendage. In some embodiments, the radial appendages may extend beyond the outer surface of the one or more intermediate layers. Therefore, in some embodiments, the thickness of the one or more intermediate layers may be limited to the length the radial appendages extend from the inner core.

In some embodiments, the hardness of the one or more intermediate layers may be similar to the hardness of the golf ball core. In other embodiments, the hardness of the one or more intermediate layers may be different than the hardness of the golf ball core. In those embodiments where the hardness of the one or more intermediate layers is different that the hardness of the golf ball core, the hardness of the one or more intermediate layers may be less than the hardness of the golf ball core. However, in other embodiments, the hardness of the one or more intermediate layers may be greater than the hardness of the golf ball core. In embodiments having two or more intermediate layers, the hardness of the two or more layers may be the same as or different from each other. The hardness of each of the two or more intermediate layers may be similar or different from the hardness of the golf ball core.

Figure 6:
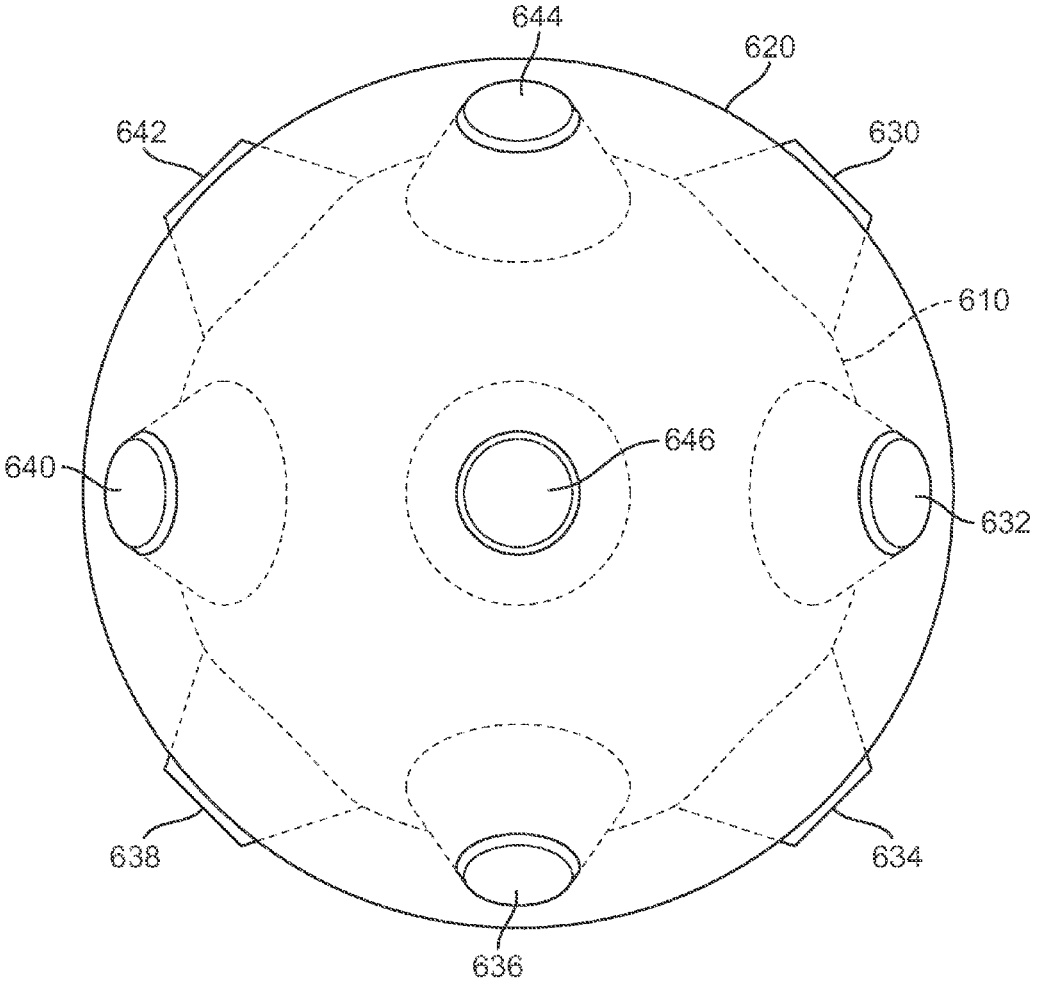
FIG. 6 is an illustration of an embodiment of a golf ball core with radial appendages and an intermediate layer.

As shown in FIG. 6, the golf ball core may be surrounded by an intermediate layer. In FIG. 6, intermediate layer 620 surrounds inner core 610 by filling in the space between first radial appendage 630, second radial appendage 632, third radial appendage 634, fourth radial appendage 636, fifth radial appendage 638, sixth radial appendage 640, seventh radial appendage 642, eight radial appendage 644, and ninth radial appendage 646. In addition, the golf ball core may contain radial appendages not shown in FIG. 6. For example, second radial appendage 632 may have a corresponding radial appendage extending from inner core 610 on the opposite of the inner core. Similarly, fourth radial appendage 636, sixth radial appendage 640, eight radial appendage 644, and ninth radial appendage 646 have corresponding radial appendages, which are not show in FIG. 6, on the opposite side of inner 610.

Further, intermediate layer 620 may not completely encapsulate the radial appendages. In some embodiments, the radial appendages may also be flush with the outer surface of the intermediate layer without being encapsulated by the intermediate layer. In other embodiments, the radial appendages may extend beyond the outer surface of intermediate layer 620. For example, radial appendage 638 may extend beyond the surface of intermediate layer 620. In embodiments where the radial appendages extend beyond the outer surface of the intermediate layer, the portion of the radial appendages that extends beyond the outer surface of the intermediate layer may be from about 1/5 to about 1/50 of the length of the radial appendage.

Figure 7:
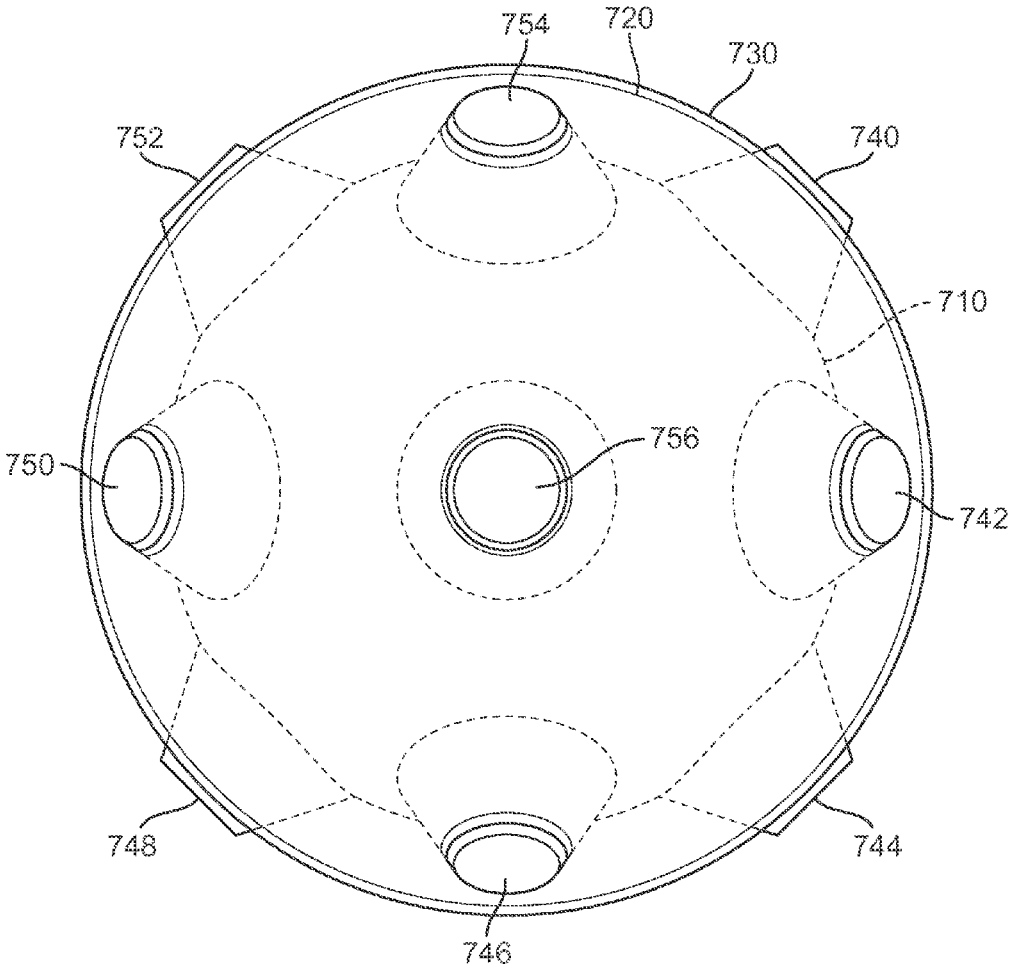
FIG. 7 shows an embodiment of a golf ball core with radial appendages and two intermediate layers.

FIG. 7 also shows an inner core 710 surrounded by first intermediate layer 720 and second intermediate layer 730. First intermediate layer 720 surrounds inner core 710 by filling in the space between first radial appendage 740, second radial appendage 742, third radial appendage 744, fourth radial appendage 746, fifth radial appendage 748, sixth radial appendage 750, seventh radial appendage 752, eight radial appendage 754, and ninth radial appendage 756 up to some radial altitude. Further, second intermediate layer 730 surrounds inner core 710 as well as first intermediate layer 720. In other words, second intermediate layer 730 may be disposed radially outward of first intermediate layer 720. Again, second intermediate layer 730 fills in the spaces between first radial appendage 740, second radial appendage 742, third radial appendage 744, fourth radial appendage 746, fifth radial appendage 748, sixth radial appendage 750, seventh radial appendage 752, eight radial appendage 754, and ninth radial appendage 756 up to some radial altitude.

Further, in the embodiment shown in FIG. 7, first intermediate layer 720 and second intermediate layer 730 may not completely encapsulate the radial appendages. In some embodiments, the radial appendages may also be flush with the outer surface of the intermediate layer without being encapsulated by the intermediate layer. In other embodiments, as shown in FIG. 7, the radial appendages, for example third radial appendage 744 and fifth radial appendage 748, extend beyond the outer surface of second intermediate layer 730. In some embodiments, at least the ends of each radial appendage extend beyond the outer surface of the one or more intermediate layers. Again, the portion of the radial appendages that extends beyond the outer surface of the intermediate layer may be from about 1/5 to about 1/50 of the length of the radial appendage.

Some embodiments of the golf ball may further include a cover layer. The cover layer may be made by any suitable process for making a golf ball cover layer. For example, in some embodiments, the cover layer may be made by a compression molding process. The process of making the cover layer may be selected based on a variety of factors. For example, the process of making the cover layer may be selected based on the type of material used to make the cover layer. The cover layer may be made using any material suitable for making a golf ball cover layer.

Embodiments of the golf ball of the disclosure may include an additional layer between the cover layer and the radial appendages and outer surface of the one or more intermediate layers. This additional layer may be made of any suitable golf ball material. The additional layer may assist with adhesion between the cover layer and the radial appendages and outer surface of the one or more intermediate layers. In some embodiments, the material selected for the additional layer may have a reduced effect on the transfer of force from the cover layer to the radial appendages, and ultimately to the inner core. In other embodiments, the material selected for the additional layer may enhance the transfer of force from the cover layer to the radial appendages, and ultimately to the inner core. Still further, in some embodiments, the material selected for the additional layer may have no effect on the transfer of force from the cover layer to the radial appendages, and ultimately to the inner core.

Figure 8:
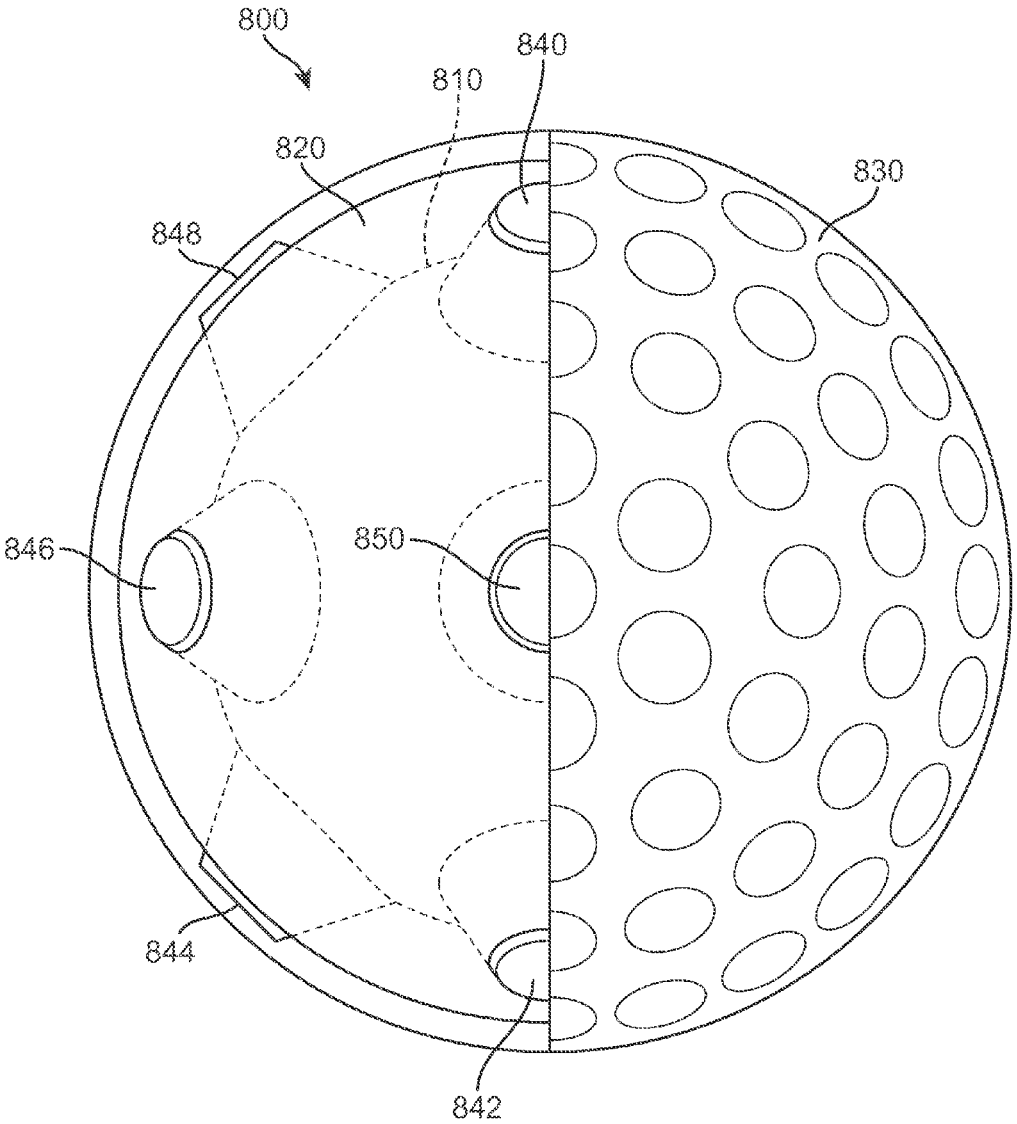
FIG. 8 shows an embodiment of a finished golf ball having a golf ball core with radial appendages, an intermediate layer, and a cover layer where a portion of the cover layer have been removed to reveal the golf ball core and intermediate layer.

FIG. 8, shows an embodiment of finished golf ball 800 having golf ball core 810, intermediate layer 820, and cover layer 830. The cover layer 830 has been cut out to reveal the interior of finished golf ball 800. Golf ball core 810 having first radial appendage 840, second radial appendage 842, third radial appendage 844, fourth radial appendage 846, fifth radial appendage 848 and sixth radial appendage 850 can be seen in FIG. 8. Intermediate layer 820 fills in the spaces between the radial appendages. However, the radial appendages extend beyond the outer surface of intermediate layer 820. For example, the cut out reveals that at least third radial appendage 844 and fifth radial appendage 848 abut, or are in contact with, the cover layer. In this embodiment, third radial appendage 844 and fifth radial appendage 848 extend into the cover layer.

Figure 9:
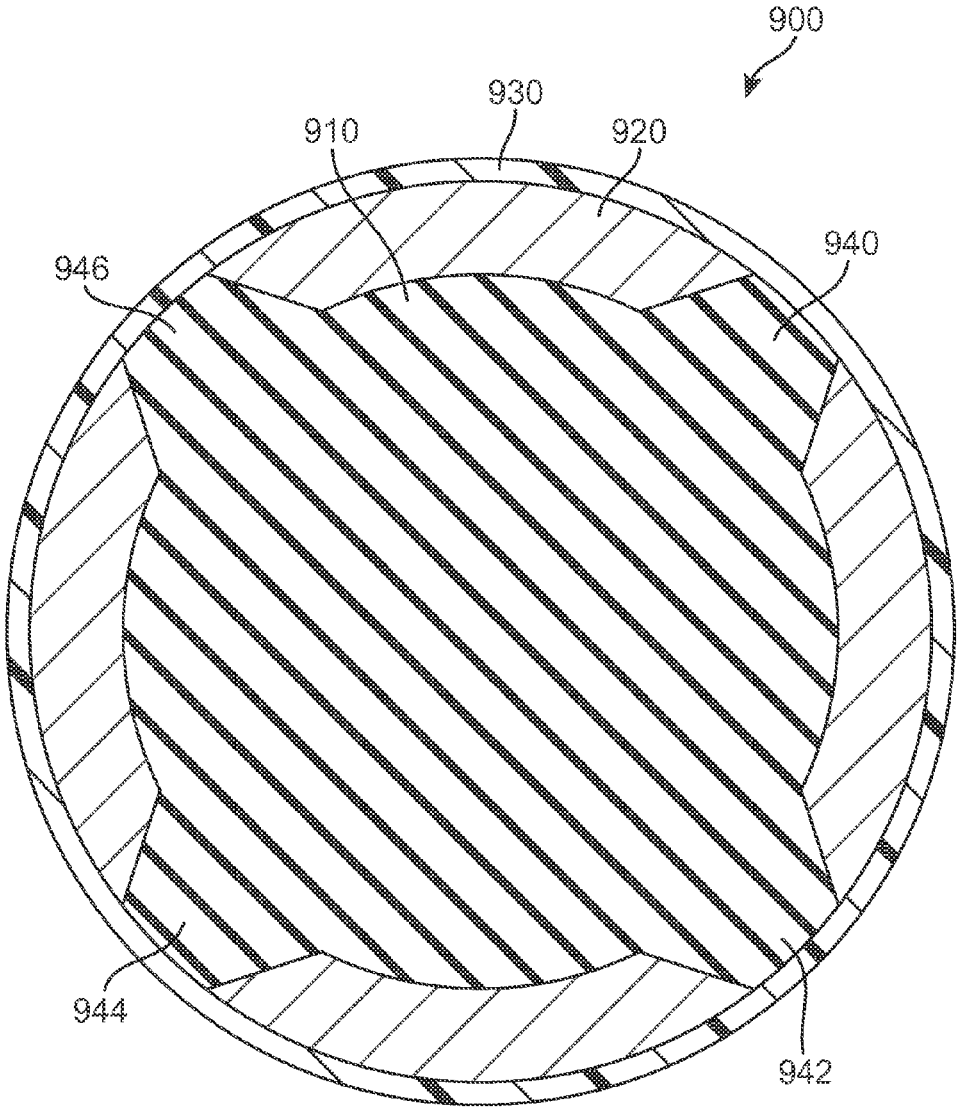
FIG. 9 shows a cross-section of an embodiment of a finished golf ball.

FIG. 9 shows a cross-section of an embodiment of a finished golf ball 900. The cross-section reveals golf ball core 910 having first radial appendage 940, second radial appendage 942, third radial appendage 944 and fourth radial appendage 946, as well as intermediate layer 920 and cover layer 930. The cross-section of finished golf ball 900 reveals a spherically symmetric golf ball core. In addition, first radial appendage 940, second radial appendage 942, third radial appendage 944 and fourth radial appendage 946 all abut, or are in contact with, cover layer 930. In embodiments where the radial appendages abut the cover layer, the impact of the golf club striking the golf ball may be transferred through the cover layer to those radial appendages abutting the portion of the cover layer being struck by the golf club face, and then through the radial appendage to the inner core.

Figure 10:
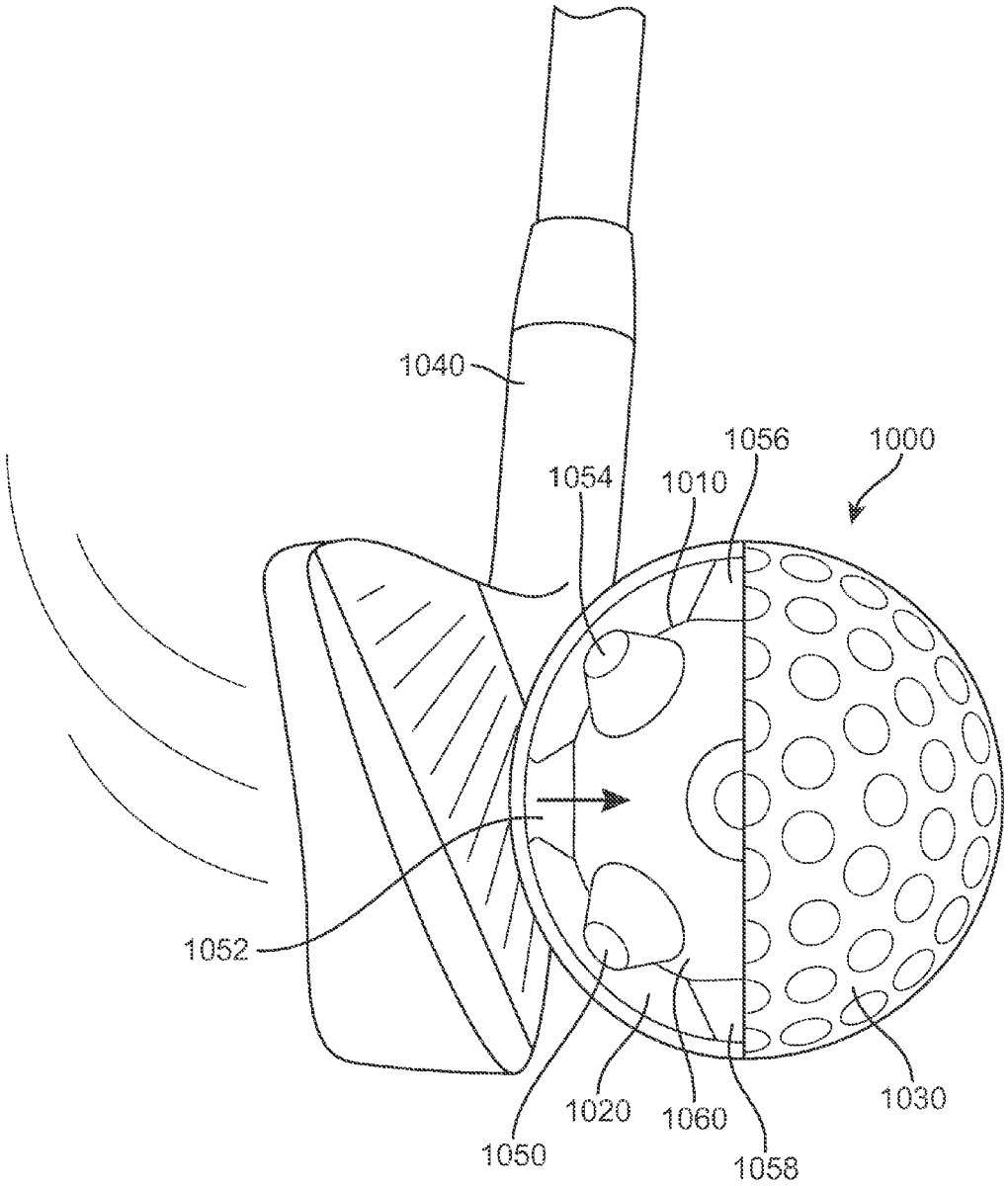
FIG. 10 shows the impact a golf club has on an embodiment of a finished golf ball.

FIG. 10 shows finished golf ball 1000 being struck by golf club 1040. Finished golf ball 1000 includes golf ball core 1010 having inner core 1060, first radial appendage 1050, second radial appendage 1052, third radial appendage 1054, fourth radial appendage 1056, and fifth radial appendage 1058, as well as intermediate layer 1020 and cover layer 1030. At least second radial appendage 1052, fourth radial appendage 1056 and fifth radial appendage 1058 of the golf ball core 1010 abut, or are in direct contact with, cover layer 1030.

When golf club 1040 strikes finished golf ball 1000, a portion of cover layer 1030 and the radial appendages in contact with that portion of cover layer 1030, for example second radial appendage 1052, may be compressed upon impact with the golf club. The impact of golf club 1040 may be transferred through the cover layer to the radial appendages in contact with that portion of the cover, for example second radial appendage 1052. Further, the force of the impact may be transferred through second radial appendage 1052 into inner core 1060 of the golf ball core 1010.

In addition to cover layer 1030 and golf ball core 1010, intermediate layer 1020 of finished golf ball 1000 also may be compressed when struck by golf club 1040. As discussed above, the one or more intermediate layers may have a hardness that is different from the hardness of the golf ball core. In some embodiments, intermediate layer 1020 may have a hardness that is less than the hardness of the golf ball core 1010. The softer intermediate layer 1020 may provide for a golf ball with a better feel and control when struck with a golf club.

The finished golf ball of the disclosure having a golf ball core with radial appendages may provide for a finished golf ball that has a better feel, without loss of drive or long iron distance. In addition, the finished golf balls of the disclosure may provide for greater control or spin of the golf ball when struck with shorter irons. Further, the finished golf balls of the disclosure may provide for better sound characteristics when struck with a golf club.

In addition to the improved play characteristics described above, the golf balls of the disclosure also may exhibit improved construction and durability. Conventional golf balls may be made with a core, a cover layer and a mantle layer between the core and cover layer. Typically, the layers of the golf ball may be held together through some type of adhesion. The adhesion may be an interaction between the materials that form the layers. The adhesion may also be an adhesive coating between the layers. In either case, adhesion between golf ball components may sometimes be problematic. For example, if the layers of a golf ball become dissociated with each other, such as delamination with adjacent layers, buckling of the material, fracturing or cracking of the material, etc., the ball would "deaden". Poor adhesion between the golf ball layers may result in layer dissociation.

The finished golf ball of the disclosure may exhibit improved durability. The finished golf ball of the disclosure may have a conventional method to adhere the intermediate layers to golf ball core. For example, the finished golf ball of the disclosure may include a chemical means for adhering adjoining layers. The chemical means may be an interaction between the materials of the golf ball core and the intermediate layers, or it may be an adhesion layer between the two components.

Figure 11:
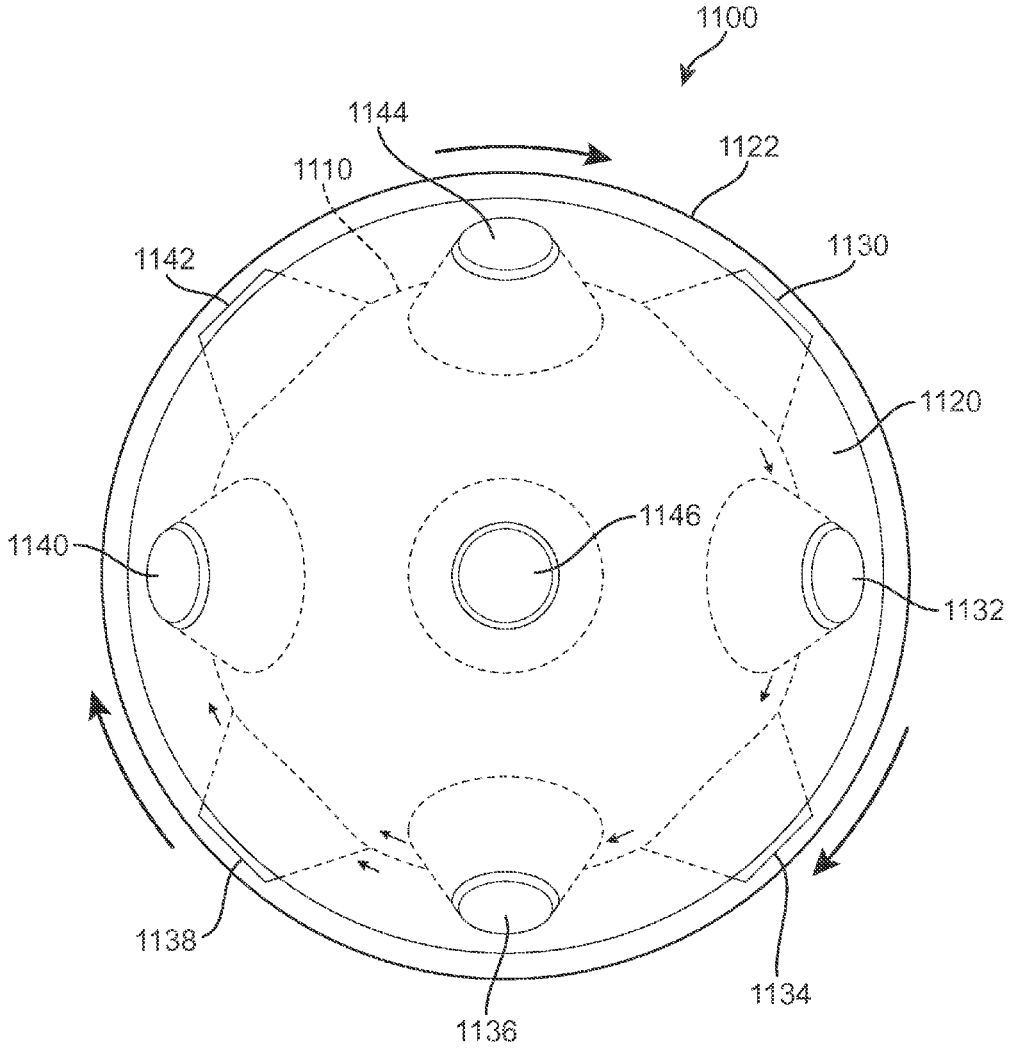
FIG. 11 shows the stressed put on an embodiment of a finished golf ball during use.

However, the finished golf ball of the disclosure may also have a mechanical means for the changing the durability of the finished golf ball. As shown the embodiment of FIG. 11, first radial appendage 1130, second radial appendage 1132, third radial appendage 1134, fourth radial appendage 1136, fifth radial appendage 1138, sixth radial appendage 1140, seventh radial appendage 1142, eight radial appendage 1144, and ninth radial appendage 1146 of finished golf ball 1100 extend from golf ball core 1110 through intermediate layer 1120. By extending through the intermediate layer, the radial appendages also may hold the intermediate layer in place mechanically. Although radial appendages in the form of tapered columns are show in FIG. 11, radial appendages of any size or shape will have a similar effect on the intermediate layers.

When a force is applied to the golf ball, the radial appendages may provide a mechanical resistance to the one or more intermediate layers moving or shifting, thereby maintaining the durability of the finished golf ball. For example, when a golf ball is spinning at a high rate (shown by the arrows rotating around finished golf ball 1100), the force of the spin may apply a stress to the adhesion between the golf ball core and the intermediate layer. The radial appendages may provide a better resistance to such a stress. This improved resistance to adhesion stress may provide for a more durable golf ball. Therefore, the golf ball of this disclosure may exhibit improved durability without sacrificing driver performance or golf ball feel.

Embodiments of the finished golf ball may be both statically and dynamically balanced. Static balance can be defined as the ability to remain at rest in any position when placed on a level surface. Dynamic balance can be defined as the ability of the axis about which a rotating body is forced to rotate to remain parallel to a principal axis of inertia. In other words, dynamic balance occurs when the mass of the body (golf ball) is evenly distributed about its rotating center line. Embodiments of the golf ball may be tuned or modified to balance the golf ball both statically and dynamically.

While the radial appendages of the golf ball core may be the form of columns, as discussed in some of the embodiments above, in other embodiments of the golf ball, the radial appendages also may take the form of any suitable shape. In some embodiments, the radial appendages may be in the shape of springs or coils.

As stated above, the shape or size of the radial appendages in the shape of springs or coils may be selected based on a variety of factors. The size and shape of the radial appendages may be selected to provide a finished golf ball with desired play characteristics. In addition, the length of each radial appendage may vary based on the size the inner core. The size of each radial appendage may depend upon the type of appendage chosen (spring, coil or column) and the material used to form the radial appendages. In addition, the golf ball core may contain a combination of radial appendages having different shapes and sizes.

In addition, the springs or coils may have any suitable stiffness or spring constant. In some embodiments, the stiffness of the radial appendage may be low. In those embodiments where the radial appendage has a low stiffness, the finished golf ball may have a softer feel. In addition, the finished golf ball having low stiffness radial appendages also may exhibit better control when struck with short irons and wedges. In some embodiments, the stiffness of the radial appendage may be high. In those embodiments where the radial appendage has a high stiffness, the finished golf may have a firmer feel. The stiffness of each radial appendage may depend on the material used to form the radial appendage. Further, the stiffness of each radial appendage may depend on the size and shape of each radial appendage. The stiffness of the radial appendages may be selected based on the desired play characteristics of the finished golf ball.

As stated above, the inner core of the disclosure may be made from any suitable material for golf balls. For example, the inner core may be made of a material suitable for injection molding. Further, the inner core may be made of a polymeric material. The polymeric material of the inner core may be a thermoplastic polymer.

Radial appendages in the form of a springs or coil may be made of any suitable material for the selected shape or configuration. Further, the material selected may be any material suitable for injection molding. Radial appendages in the form of a spring or coil may be made of the same material as the inner core. The radial appendages may be made of a polymer. The polymer may be a thermoplastic polymer.

Figure 12:
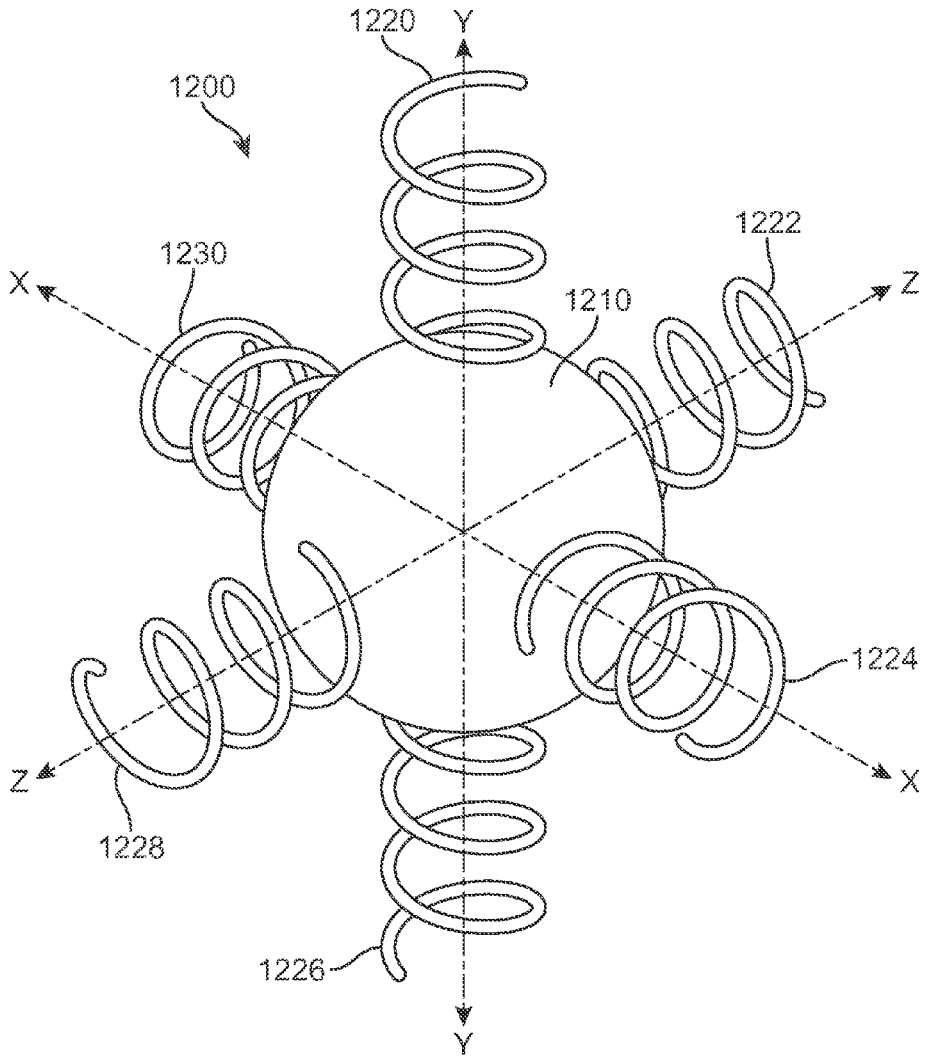
FIG. 12 shows an embodiment of a golf ball core with radial appendages that are coils or springs.

FIG. 12 shows an embodiment of a golf ball core 1200 having an inner core 1210 and first radial appendage 1220, second radial appendage 1222, third radial appendage 1224, fourth radial appendage 1226, fifth radial appendage 1228, and sixth radial appendage 1230. The radial appendages may be arranged in a spherically symmetric pattern extending from the inner core 1210. As can be seen, the radial appendages of some embodiments may be arranged along the x, y, and z axes.

In the embodiment shown in FIG. 12, golf ball core 1200 shows that the golf ball core may be spherically symmetric. Each radial appendage that extends from inner core 1210 may have a similar appendage extended from inner core 1210 on the opposite side of inner core 1210. For example, radial appendage 1230 extends in one direction from inner core 1210 on one side, and radial appendage 1224 extends in the opposite direction from inner core 1210 on the opposite side of the inner core. In addition, the radial appendages may be spaced an equal distance from each other on inner core 1210. As discussed above, regulating and controlling the spacing between adjacent and non-adjacent appendages may also help maintain spherical symmetry.

Similarly to some embodiments disclosed above, and incorporated in its entirety here, the golf ball of the disclosure having a golf ball core with springs or coils as radial appendages may include one or more intermediate layers. In addition, the one or more intermediate layers may be made from any known golf ball material. In embodiments where two or more intermediate layers are formed, the materials forming the two or more layers may be the same as or different from each other.

In some embodiments, the hardness of the one or more intermediate layers may be the same as the hardness of the golf ball core. However, the hardness of the one or more intermediate layers may be different than the hardness of the golf ball core. When the hardness of the of the one or more intermediate layers is different from the hardness of the golf ball core, the hardness of the one or more intermediate layers may be less than the hardness of the golf ball core. In other embodiments, the hardness of the one or more intermediate layers may be greater than the hardness of the golf ball core. In embodiments having two or more intermediate layers, the hardness of the two or more layers may be the same as or different from each other.

Further, when struck with a golf club, the intermediate layers may compress differently that the radial appendages. In some embodiments, the intermediate layers may compress more easily than the radial appendages. In such embodiments, the golf ball may exhibit a softer feel and better spin control. In other embodiments, the intermediate layers may compress less easily than the radial appendages. In such embodiments, the golf ball may exhibit a firmer feel.

Figure 13:
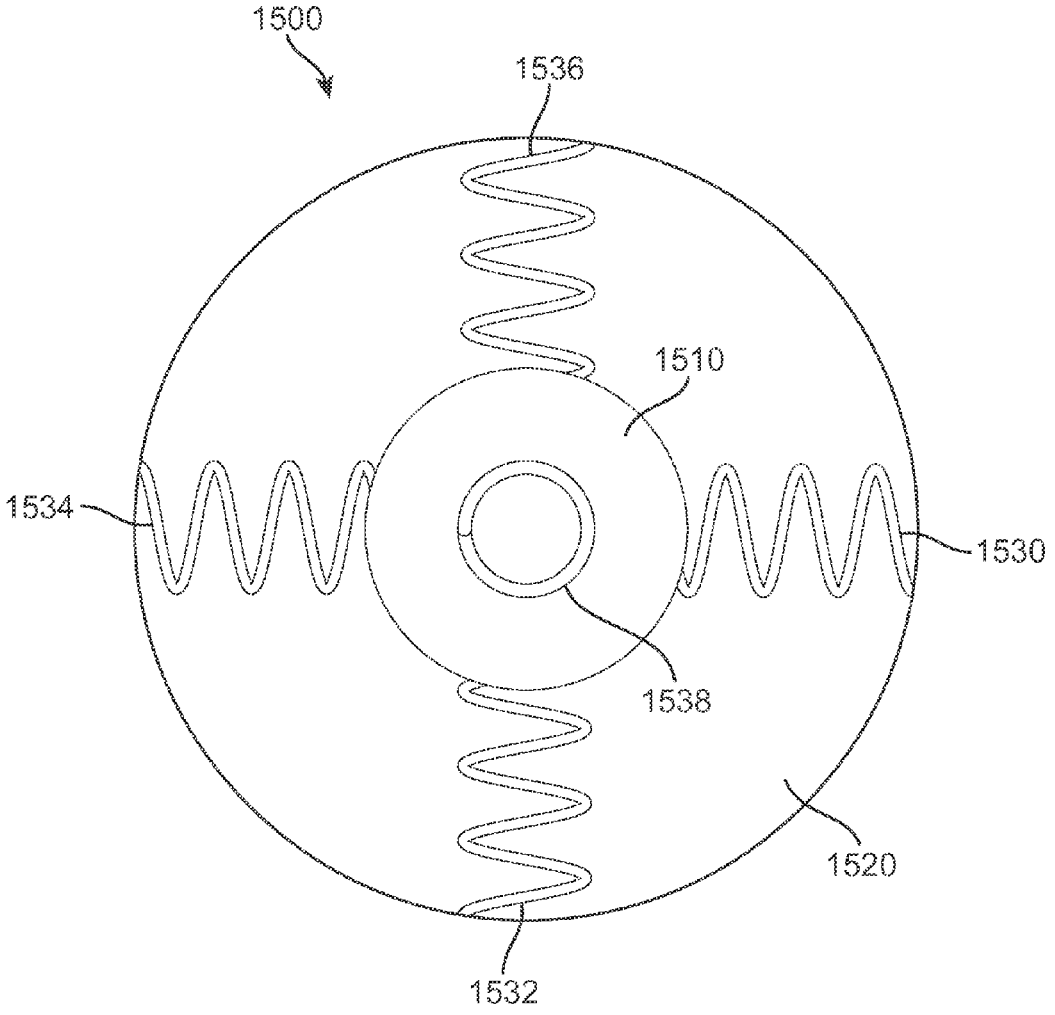
FIG. 13 shows an embodiment of a golf ball core with springs or coils as radial appendages and an intermediate layer.

In the embodiment shown in FIG. 13, golf ball core 1500 may be surrounded by one or more intermediate layers. In FIG. 13, intermediate layer 1520 may radially surround inner core 1510 by filling in the space between first radial appendage 1530, second radial appendage 1532, third radial appendage 1534, fourth radial appendage 1536, and fifth radial appendage 1538. In some cases, intermediate layer 1520 may encapsulate the radial appendages. In other embodiments, intermediate layer 1520 may not completely encapsulate the radial appendages. For example, radial appendage 1532 may extend beyond the outer surface of intermediate layer 1520.

Figure 14:
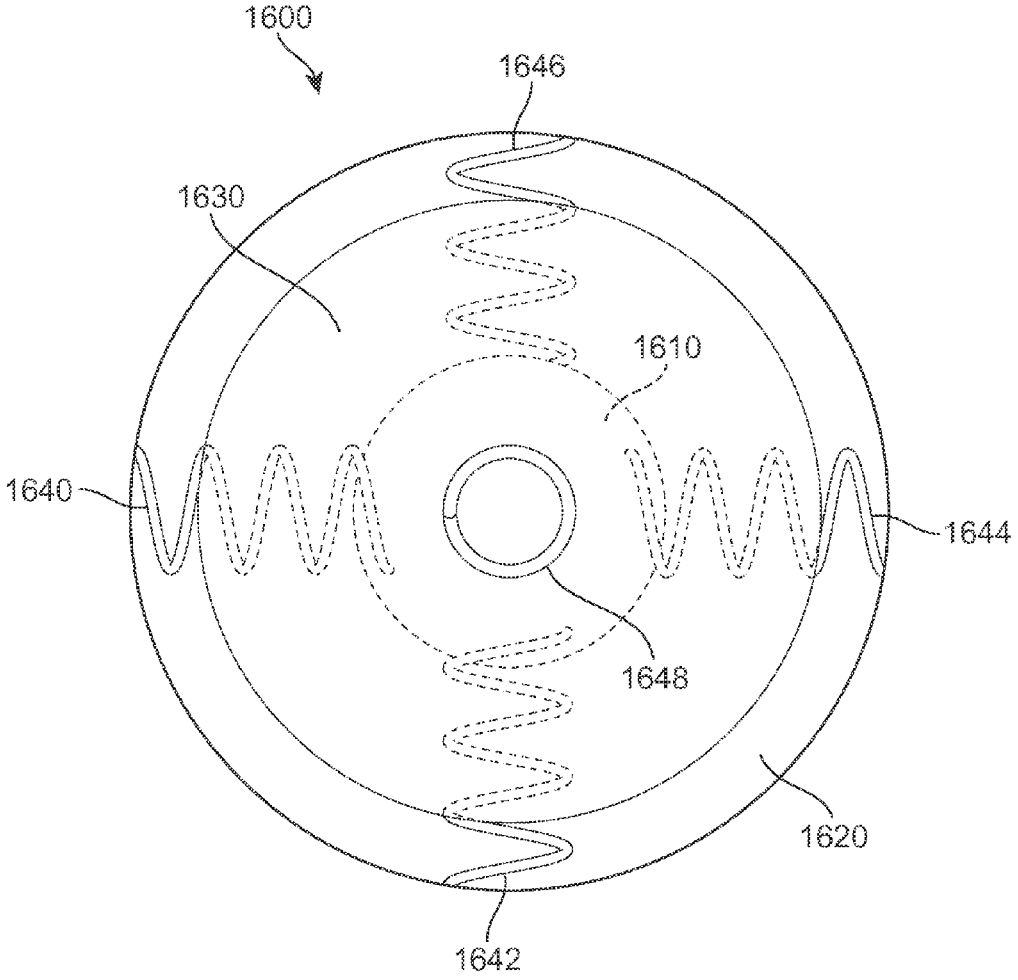
FIG. 14 shows an embodiment of a golf ball core with springs or coils as radial appendages and two intermediate layers.

FIG. 14 also shows a golf ball core 1600 surrounded by first intermediate layer 1620 and second intermediate layer 1630. First intermediate layer 1620 may radially surround inner core 1610 by filling in the space between first radial appendage 1640, second radial appendage 1642, third radial appendage 1644, fourth radial appendage 1646, and fifth radial appendage 1648. Further, second intermediate layer 1630 may radially surround golf ball core 1610 as well as first intermediate layer 1620. Again, second intermediate layer 1630 may fill in the spaces between first radial appendage 1640, second radial appendage 1642, third radial appendage 1644, fourth radial appendage 1646, and fifth radial appendage 1648. In some cases, second intermediate layer 1630 may encapsulate the radial appendages. In other embodiments, first intermediate layer 1620 and second intermediate layer 1630 may not completely encapsulate the radial appendages. For example, radial appendage 1640 may extend beyond the outer surface of second intermediate layer 1630.

As stated above, and incorporated in its entirety here, a cover layer may be made by any suitable process for making a golf ball cover layer. Further, as stated above and incorporated in its entirety here, embodiments of the golf ball of the disclosure may include an additional layer between the cover layer and the radial appendages and outer surface of the one or more intermediate layers. This additional layer may be made of any suitable golf ball material.

Figure 15:
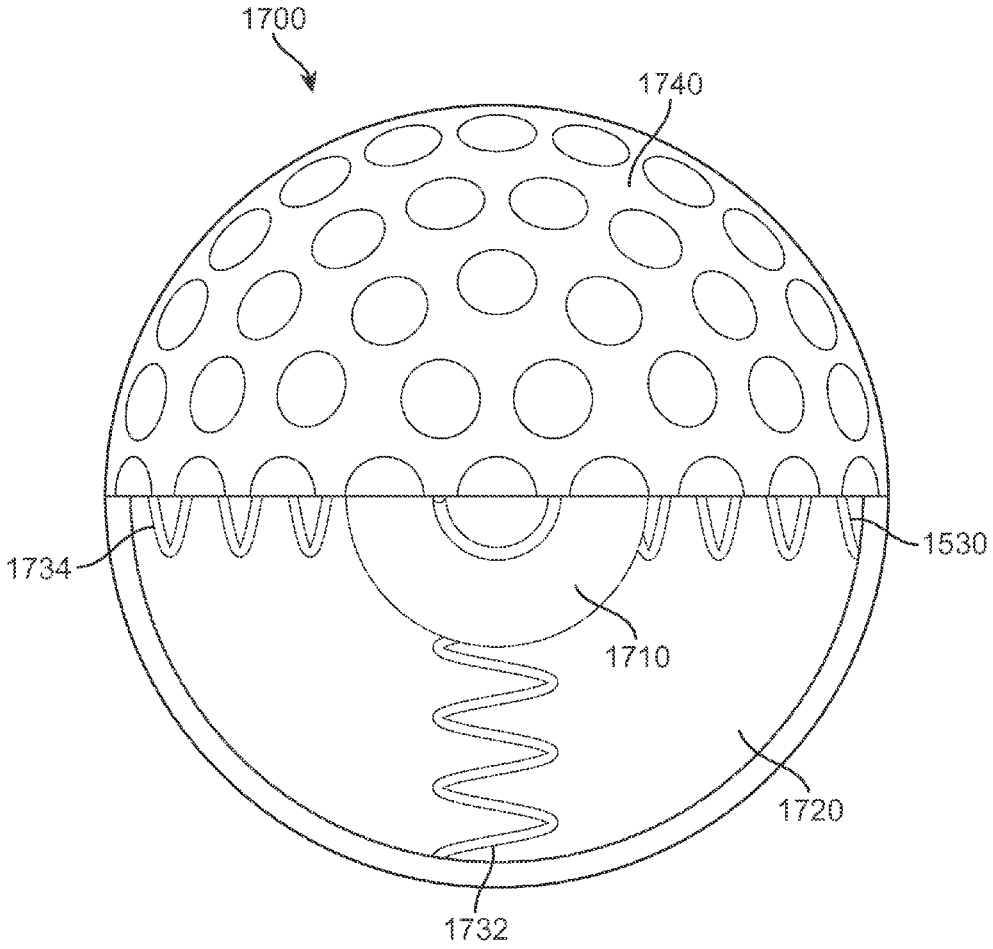
FIG. 15 shows an embodiment of a finished golf ball having a golf ball core with coils or springs as radial appendages, an intermediate layer, and a cover layer where a portion of the cover layer have been removed to reveal the golf ball core and intermediate layer.

FIG. 15, shows an embodiment of finished golf ball 1700 having inner core 1710, intermediate layer 1720, and cover layer 1740. The cover layer 1740 has been cut out to reveal the interior of finished golf ball 1700. Inner core 1710 includes first radial appendage 1730, second radial appendage 1732, and third radial appendage 1734, as can be seen in FIG. 15. Intermediate layer 1720 may fill in the spaces between the radial appendages but may not completely encapsulate the radial appendages. For example, the cut out reveals that third radial appendage 1730 may abut, or may be in contact with, the cover layer.

Figure 16:
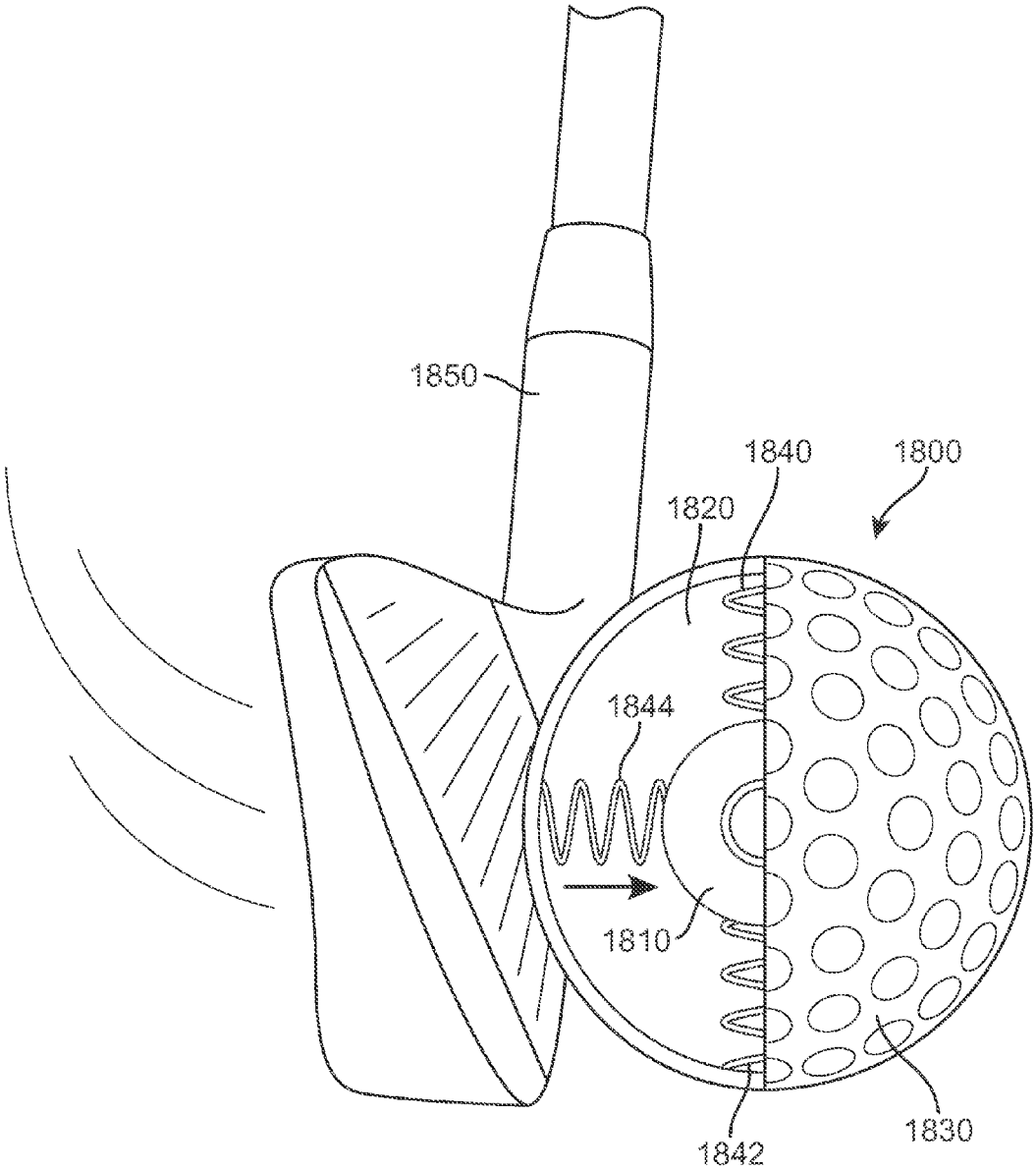
FIG. 16 shows the impact a golf club has on an embodiment of a finished golf ball having a golf ball core with springs or coils as radial appendages.

In some embodiments, the radial appendages may abut the cover layer. The impact of the golf club striking the golf ball may be transferred through the cover layer to those radial appendages abutting the portion of the cover layer being struck by the golf club face, and then through the radial appendage to the inner core. In the embodiment shown in FIG. 16, finished golf ball 1800 may be struck by golf club 1850. Finished golf ball 1800 includes golf ball core 1810 having first radial appendage 1840, second radial appendage 1842, and third radial appendage 1844 as well as intermediate layer 1820 and cover layer 1830. At least third radial appendage 1844 of the golf ball core 1810 may abut, or may be in direct contact with, cover layer 1830. When golf club 1850 strikes finished golf ball 1800, cover layer 1830 and the radial appendages in contact with that portion of cover layer 1830, for example third radial appendage 1844, may be compressed upon impact with the golf club. The impact of golf club 1850 may be transferred through the radial appendages, for example third radial appendage 1844, into inner core 1810.

In addition to cover layer 1830 and inner core 1810, intermediate layer 1820 of finished golf ball 1800 also may be compressed when struck by golf club 1850. In some embodiments, intermediate layer 1820 may have a hardness that is less than the hardness of the golf ball core 1810. The softer intermediate layer 1820 may provide for a golf ball with a better feel when struck with a golf club.

As discussed above, the finished golf ball of the disclosure having a golf ball core with radial appendages may provide for a finished golf ball that has a better feel, without loss of drive or long iron distance. In addition, the finished golf balls of the disclosure may provide for greater control or spin of the golf ball when struck with shorter irons. Further, the finished golf balls of the disclosure may provide for better sound characteristics when struck with a golf club.

In addition to the improved play characteristics described above, the golf balls of the disclosure also may exhibit improved construction and durability. The finished golf ball of the disclosure may have a mechanical means for the changing the durability of the finished golf ball. By extending through the intermediate layer, the radial appendages also may hold the intermediate layer in place mechanically.

When a force is applied to the golf ball, the radial appendages may provide a mechanical resistance to the one or more intermediate layers moving or shifting, thereby maintaining the durability of the finished golf ball. This improved resistance to adhesion stress may provide for a more durable golf ball. Therefore, the golf ball of this disclosure may exhibit improved durability without sacrificing driver performance or golf ball feel.

Embodiments of the finished golf ball may be both statically and dynamically balanced. Embodiments of the golf ball may be tuned or modified to balance the golf ball both statically and dynamically.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A golf ball comprising:

a golf ball core having:

an inner core; and radial appendages that extend from the inner core in a spherically symmetric pattern;

one or more intermediate layers;

a cover layer;

wherein the radial appendages abut the cover layer; and wherein the radial appendages extend beyond an outer surface of the one or more intermediate layers.

2. The golf ball according to claim 1, wherein the golf ball core is one molded piece.

3. The golf ball according to claim 1, wherein the radial appendages are selected from the group consisting of springs, coils, columns, or combinations thereof.

4. The golf ball according to claim 1, wherein the radial appendages provide mechanical adhesion to the one or more intermediate layers.

5. The golf ball according to claim 1, wherein the inner core is formed from a thermoplastic polymer or an ionomer.

6. The golf ball according to claim 5, wherein at least one of the one or more intermediate layers is formed from a resin.

7. The golf ball according to claim 1, wherein the inner core is formed from a resin.

8. The golf ball according to claim 7, wherein at least one of the one or more intermediate layers is formed from a thermoplastic polymer or an ionomer.

9. The golf ball according to claim 1, wherein at least one of the radial appendages includes a top portion and a base portion;

wherein the base portion couples the at least one of the radial appendages to the inner core; and wherein the base portion is wider than the top portion.

10. The golf ball according to claim 9, wherein the top portion is at least one of flat, convex, or domed.

11. The golf ball according to claim 1, wherein the inner core has a first hardness, and wherein the intermediate layer has a second hardness; and wherein the first hardness is greater than the second hardness.

12. The golf ball according to claim 1, wherein the inner core has a first hardness, and wherein the intermediate layer has a second hardness; and wherein the first hardness is less than the second hardness.

* * * * *